US005875839A

United States Patent [19]

Kim et al.

[11] Patent Number: 5,875,839

[45] Date of Patent: Mar. 2, 1999

[54] HEAT EXCHANGER FOR AIR CONDITIONER

[75] Inventors: Young-Saeng Kim, Inchŏ; Baek Youn, Suwon, both of Rep. of Korea

[73] Assignee: Samsung Electronics Co., Ltd., Suwon, Rep. of Korea

[21] Appl. No.: 870,411

[22] Filed: Jun. 5, 1997

Related U.S. Application Data

[63] Continuation of Ser. No. 547,785, Oct. 25, 1995, abandoned.

[30] Foreign Application Priority Data

Oct. 25, 1994 [KR] Rep. of Korea ..... 1994 27914

[51] Int. Cl.[6] ..... F28D 1/04

[52] U.S. Cl. ..... 165/151; 165/181

[58] Field of Search ..... 165/181, 151

[56] References Cited

U.S. PATENT DOCUMENTS

| | | | |
|---|---|---|---|
| 3,916,989 | 11/1975 | Harada et al. | 165/151 |
| 4,550,776 | 11/1985 | Lu | 165/151 |
| 4,832,117 | 5/1989 | Kato et al. | 165/151 |
| 5,042,576 | 8/1991 | Broadbent | 165/151 |
| 5,117,902 | 6/1992 | Kusuhara et al. | 165/151 |
| 5,170,842 | 12/1992 | Kato et al. | 165/151 |

FOREIGN PATENT DOCUMENTS

| | | | |
|---|---|---|---|
| 0144892 | 9/1982 | Japan | 165/151 |
| 0178293 | 9/1985 | Japan | 165/181 |
| 0183391 | 7/1988 | Japan | 165/151 |
| 0310296 | 12/1989 | Japan | 165/151 |
| 0064397 | 5/1990 | Japan | 165/151 |
| 0136696 | 5/1990 | Japan | 165/151 |

*Primary Examiner*—Ira S. Lazarus
*Assistant Examiner*—Christopher Atkinson
*Attorney, Agent, or Firm*—Burns, Doane, Swecker & Mathis, L.L.P.

[57] ABSTRACT

The present invention relates to a heat exchanger for air conditioners having a plurality of a slit type grilles in each flat fin and making the air currents passing by the fin become turbulent flows and mixing the air currents together, to thereby improve the heat exchanging efficiency and reducing a cavitation zone formed in the back of each heat transfer pipe.

4 Claims, 5 Drawing Sheets

HEAT EXCHANGER FOR AIR CONDITIONER

This application is a continuation of application Ser. No. 08/547,785, filed Oct. 25, 1995, now abandoned.

BACKGROUND OF THE INVENTION

1. Field of the Invention

The present invention relates in general to a heat exchanger for an air conditioner and, more particularly, to a heat exchanger having a slit type grille in each flat fin and making the air currents passing by the fin, such as room air currents, become turbulent flows and mixing the above air currents together, thereby improving the heat exchanging efficiency and reducing the cavitation zone formed in the back of each heat transfer pipe.

2. Description of the Prior Art

With reference to FIG. 1, there is shown the construction of a conventional heat exchanger for an air conditioner. As shown in the above drawing, the conventional heat exchanger includes a plurality of regularly spaced flat fins 1. The fins 1 are vertically arranged such that they parallel each other. A plurality of heat transfer pipes 2 are angularly fitted into the fins 1 such that the pipes 2 are perpendicular to the fins 1. The air currents flow in the space defined between the fins 1 in the direction of the arrow in FIG. 1 and exchange heat with the fluid flowing in the heat transfer pipes 2.

A thermal fluid flowing about each flat fin 1 has the characteristic in that the thickness of the thermal boundary layer 3 on both heat transfer surfaces of the fin 1 is gradually increased in proportion to the square root of the distance from the air current inlet end of the fin 1 as shown in FIG. 2. In this regard, the heat transfer rate of the fin 1 is remarkably reduced in proportion to the distance from the air current inlet end. Therefore, the above heat exchanger has a lower heat transfer efficiency.

When lower velocity air currents flow in the direction of the arrow of FIG. 3, the thermal fluid flowing about each heat transfer pipe 2 has the characteristic in that the air currents separate from the outer surface of the pipe 2 at portions spaced apart from the stagnation point of the pipe 2 at points spaced apart by an angle $2\theta$ in the range of 70°~80°. Therefore, a cavitation zone 4 is formed in the back of the pipe 2 as shown in the cross-hatched region of FIG. 3. In the above cavitation zone 4, the heat transfer rate of the pipe 2 is remarkably reduced so that the heat transfer efficiency of the above heat exchanger become worse.

In order to overcome the above problems, Japanese U.N. Laid-open Publication No. Sho.55-110995 proposes an improved heat exchanger for air conditioners. As shown in FIG. 4, the above Japanese heat exchanger includes a plurality of heat transfer pipes 2 which are fitted into the regularly spaced flat fins 1 such that the pipes 2 are perpendicular to the fins 1. The above heat exchanger also includes a plurality of slit type grille which are formed beside the pipes 2 on each fin 1. Each slit type grille is formed by vertically slitting a given portion of the fin 1 several times and alternately bending the remaining strips in opposite directions, thereby forming a plurality bent strips 5*a*, 5*b*, 5*c*, 5*d*, 5*e* and 5*f* in the fin 1.

In other words, three strips 5*a*, 5*c* and 5*e* are bent to one side of the fin 1 such that the strips 5*a*, 5*b* and 5*c* are regularly spaced apart from each other. However, the other three strips 5*b*, 5*d* and 5*f* placed between the above strips 5*a*, 5*c* and 5*e* are bent to the other side of the fin 1.

The above heat exchanger having the plurality of slit type grilles on each flat fin 1 causes the heat exchanging fluid to become turbulent due to the above grilles, thereby reducing the thickness of the thermal boundary layers formed on the fins 1. As the above heat exchanger has thin thermal boundary layers formed on the fins 1 due to the slit type grilles, this heat exchanger somewhat improves the heat transfer efficiency in comparison with the conventional heat exchanger having the flat fins 1 with no slit type grilles. When the partial heat transfer capacities of the heat exchanger are measured, the upstream strips 5*a* and 5*b* create the thin thermal boundary layers, thus to improve the heat transfer efficiency. However, as the downstream strips 5*c* to 5*f* are included in the thermal boundary layers formed by the upstream strips 5*a* and 5*b*, the downstream strips 5*c* to 5*f* can not improve the heat transfer efficiency. In addition, the cavitation zone is still formed in the back of each heat transfer pipe 2. Furthermore, the air currents flowing in the space defined between the flat fins 1 are not mixed together but become laminar. Therefore, the above Japanese heat exchanger is not expected to improve the heat transfer efficiency which would be improved if the air currents are mixed together.

SUMMARY OF THE INVENTION

It is, therefore, an object of the present invention to provide a heat exchanger for air conditioners in which the above problems can be overcome and which mixes the turbulent flows on the flat fins together and improves the heat transfer efficiency and effectively reduces the cavitation zone formed in the back of each heat transfer pipe.

In order to accomplish the above object, a preferred embodiment of the present invention provides a heat exchanger for air conditioners comprising a plurality of regularly spaced flat fins disposed parallel to each other for letting the air currents flow in the space defined between the fins, and a plurality of heat transfer pipes fitted into the fins and extending perpendicular to the fins and being in a zigzagged pattern when viewing the pipes from one side of the fin, wherein the improvement comprises: a plurality of slit type grilles so that the air currents flowing between surfaces of the plurality of flat fins and inner sides thereof can become turbulent and mixed while passing around the heat transfer pipes, whereas the slit type grills are radiantly disposed toward the center of the heat transfer pipes, to thereby cause the cross section of the slits to increase in a direction away from the respective pipe.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF A PREFERRED EMBODIMENT OF THE INVENTION

Figure 1:
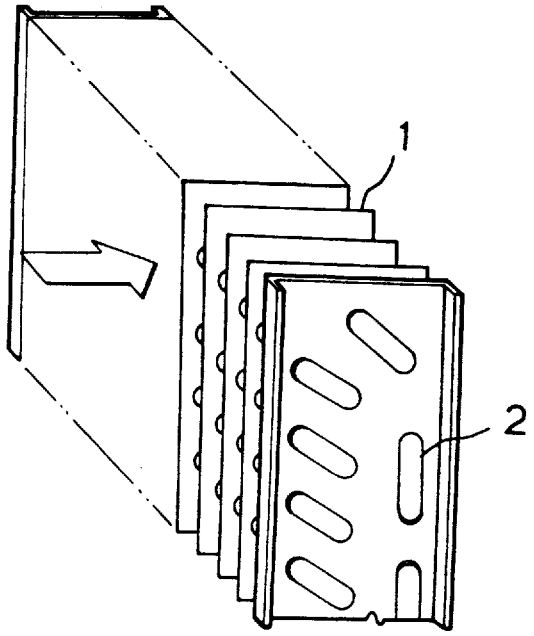
FIG.1 (PRIOR ART)
FIG. 1 is a perspective view showing the construction of a conventional heat exchanger for air conditioners.
Figure 2:
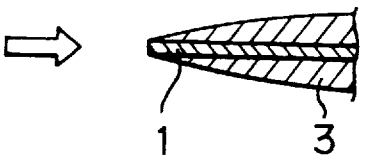
FIG.2 (PRIOR ART)
FIG. 2 is an enlarged sectional view of a flat fin of the heat exchanger of FIG. 1, showing the characteristic of the thermal fluid flowing about the fin.
Figure 3:
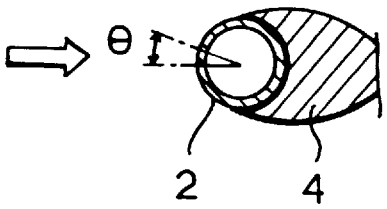
FIG.3 (PRIOR ART)
FIG. 3 is an enlarged sectional view of a heat transfer pipe of the heat exchanger of FIG. 1, showing the characteristic of the thermal fluid flowing about the heat transfer pipe.
Figure 4:
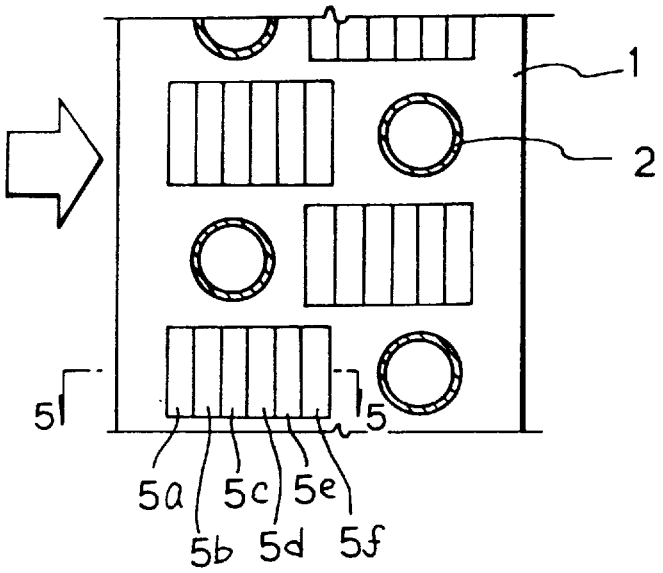
FIG.4 (PRIOR ART)
FIG. 4 is a side view of a flat fin having a plurality of slit type grilles in accordance with another type of prior art.
Figure 5:
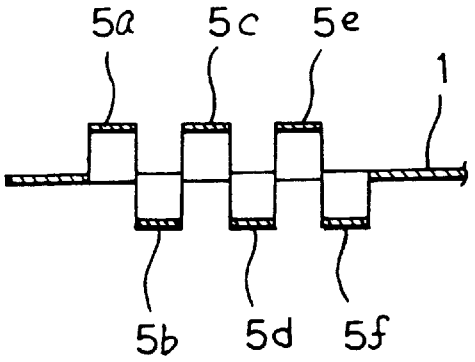
FIG.5 (PRIOR ART)
FIG. 5 is a sectional view of one slit type grille of the flat fin taken along the section line 5—5 of FIG. 4.

The preferred embodiment of the present invention will now be described in detail with reference to the accompanying drawings.

Throughout the drawings, like reference numerals and symbols are used for designation of like or equivalent parts or portions, for simplicity of illustration and explanation.

Figure 6:
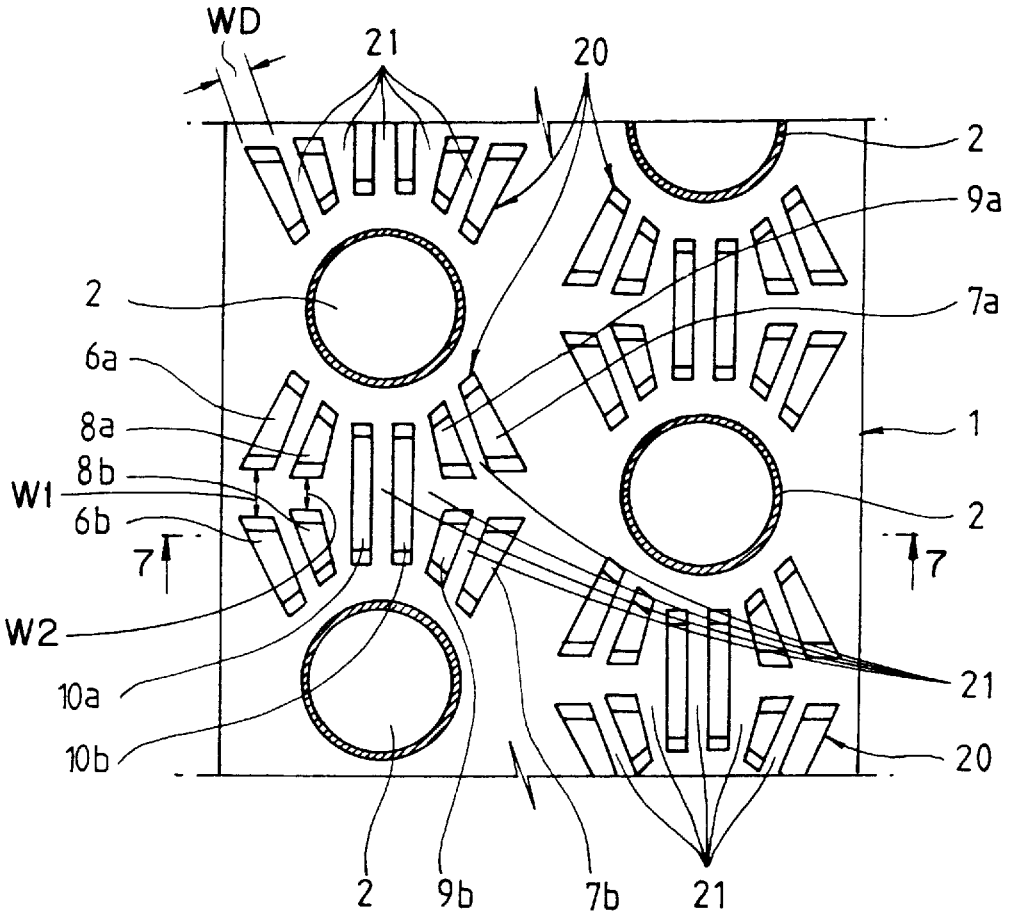
FIG. 6 is a side view of a flat fin of a heat exchanger for air conditioners in accordance with a preferred embodiment of the present invention.
Figure 7:
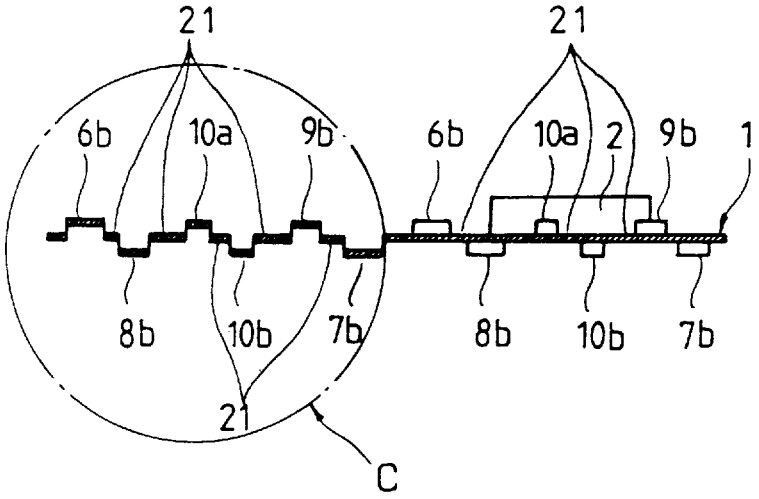
FIG. 7 is a sectional view of the flat fin taken along the section line 7—7 of FIG. 6.
Figure 8:
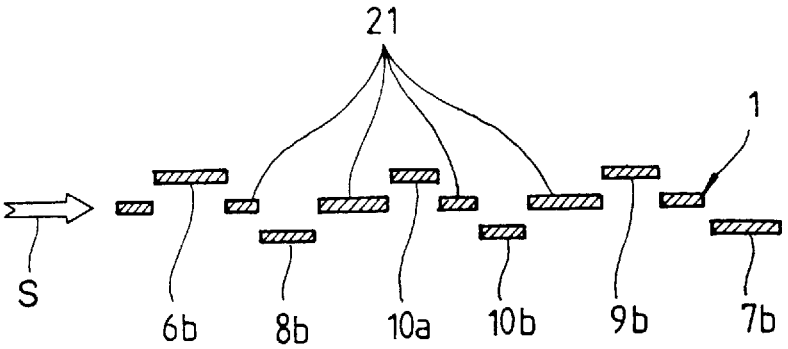
FIG. 8 is an enlarged view of the portion C of FIG. 7, showing the air currents flowing about the grilles of the fin.

With reference to the drawings, FIG. 6 is a front view of a flat fin of a heat exchanger for air conditioners in accordance with a preferred embodiment of the present invention, FIG. 7 is a sectional view of the flat fin taken along the section line 7—7 of FIG. 6 and FIG. 8 is an enlarged view of the portion C of FIG. 7, showing the air currents flowing about the grilles of the fin.

As shown in FIG. 6, the heat exchanger of this invention includes a plurality of flat fins 1 which are regularly spaced apart from each other and parallel to each other, thus letting the air currents flow in the space defined between them, a plurality of heat transfer pipes 2 fitted into the fins 1 such that the pipes 2 are perpendicular to the fins 1 and oriented in a zig-zag fashion in order to let the air currents flow inward and a plurality of slit type grilles 20 opened in the flow direction of air currents so that the air currents flowing between surfaces of the plurality of flat fins 1 and can become turbulent and mixed together around the heat transfer pipes 2, whereas the slit type grilles 20 are radiantly disposed toward the center of the heat transfer pipes. The cross sectional width WD of each of the slit type grilles becomes greater in a direction away from a respective pipe 2.

In this case, the plurality of slit type grilles 20 are formed such that a predetermined number of bases 21 are respectively positioned thereamong and alternately formed up and down.

The plurality of slit type grilles 20 are divided into groups of grilles, each including first and second slits 6*a* and 6*b* vertically spaced apart and extending up and down in each fin 1 and arranged vertically symmetric to each other with a predetermined slant relative to vertical, so that air currents become turbulent flows when the same pass by the fin 1 at the front (i.e., left side) of the plurality of heat transfer pipes 2, third and fourth slits 7*a* and 7*b* vertically spaced apart and extending up and down in each fin in the back of the pipes 2 and vertically symmetric to the fin 1 with a predetermined slant relative to vertical, so that the air currents become turbulent flows when the same pass by the fin 1 at the back of the pipes 2, fifth and sixth slits B*a* and 8*b* vertically spaced apart and extending up and down in the fin 1 at the back of the first and second slits 6*a* and 6*b* and vertically symmetric to each other with a predetermined slant relative to vertical so that the air current become turbulent flows when the same pass by the fin 1 at the front of the pipes 2, seventh and eighth slits 9*a* and 9*b* vertically spaced apart and extending up and down in the back of the pipe 2 and vertically symmetric at the front of the fin 1 with a predetermined slant relative to vertical so that the air currents become turbulent flows when the same pass by the fin 1 at the back of the pipes 2, and ninth and tenth slits 10*a* and 10*b* horizontally spaced apart and extending vertically between the fifth and sixth slits (8*a* and 8*b*) and the seventh and eighth (9*a* and 9*b*) so that the turbulent air flows can be mixed to thereby reduce a cavitation zone formed at the back of the pipe 2.

The bases 21 formed between the first slit 6*a* and the second slit 6*b*, and between the third slit 7*a* and the fourth slit 7*b*, are wider than bases 21 formed between the fifth slit 8*a* and the sixth slit 8*b*, and the seventh slit 9*a* and the eighth slit 9*b*. That is, W1 is greater than W2 in FIG. 6.

Sectional areas the first, second, third and fourth slits 6*a*, 6*b*, 7*a* and 7*b* are formed larger than those of the fifth, sixth, seventh and the eighth slits 8*a*, 8*b*, 9*a* and 9*b*.

Furthermore, the second, ninth, and eighth slits 6*b*, 10*a*, and 9*b* protrude from one surface of the fin, as illustrated in FIG. 7, and are arranged at predetermined horizontal intervals. The same is true of the first and seventh slits 6*a* and 9*a* that are not shown in FIG. 7.

The fifth, sixth, tenth, third and fourth slits 8*a*, 8*b*, 10*b*, 7*a* and 7*b* protrude from an opposite side of the fin and are arranged in staggered relationship relative to the first, second, ninth, seventh and the eighth slits 6*a*, 6*b*, 10*a*, 9*a* and 9*b*.

The operational effect of the above heat exchanger will be described hereinafter.

When the air currents flow in the direction of the arrow S of FIG. 8, the air currents flow into the sp ace defined between the flat fins 1 and pass by the first to eighth slits 6*a*, 6*b*, 7*a*, 7*b*, 8*a*, 8*b*, 9*a*, 9*b* to become turbulent to improve the heat transfer efficiency at the opposite sides of the fins 1. When the air currents pass by each slit 10, the air currents are separated into two flows which will be mixed together later. The grilles 20 thus reduce the cavitation zones formed in the back of the heat transfer pipes 2, In other words, because the first, second, ninth seventh and eighth slits 6*a*, 6*b*, 10*a*, 9*a* and 9*b* of the grilles 20 are protrudingly formed at one side of the flat fin 1 so that the same are with respect to the fifth, sixth, tenth, third and fourth slits 8*a*, 8*b*, 10*b*, 7*a* and 7*b* protrudingly formed at the other side of the flat fin 1, they are not included in thermal boundary layers formed by the fifth, sixth, tenth, third and fourth slits 8*a*, 8*b*, 10*b*, 7*a* and 7*b* in the direction of the air flow. Therefore, the heat transfer efficiency of the heat exchanger can be improved.

In addition, the first to tenth slits 6*a*, 6*b*, 7*a*, 7*b*, 8*a*, 8*b*, 9*a*, 9*b*, 10*a* and 10*b* of each slit type grille 20 are so arranged to form a generally X-shaped arrangement as shown in FIG. 6. Therefore, the air currents rapidly become turbulent while flowing about the pipes 2, thus reducing the cavitation zones 4 formed in the back of the pipes 2 and improving the heat transfer efficiency in the back of the pipes 2.

Furthermore, because the slits are so constructed as to have a width WD that becomes larger the further it is from a respective pipe, the heat transfer phenomenon can be improved in between the plurality of the heat transfer pipes 2 having weak heat transfer capabilities, to thereby heighten overall heat transfer efficiency.

Figure 9:
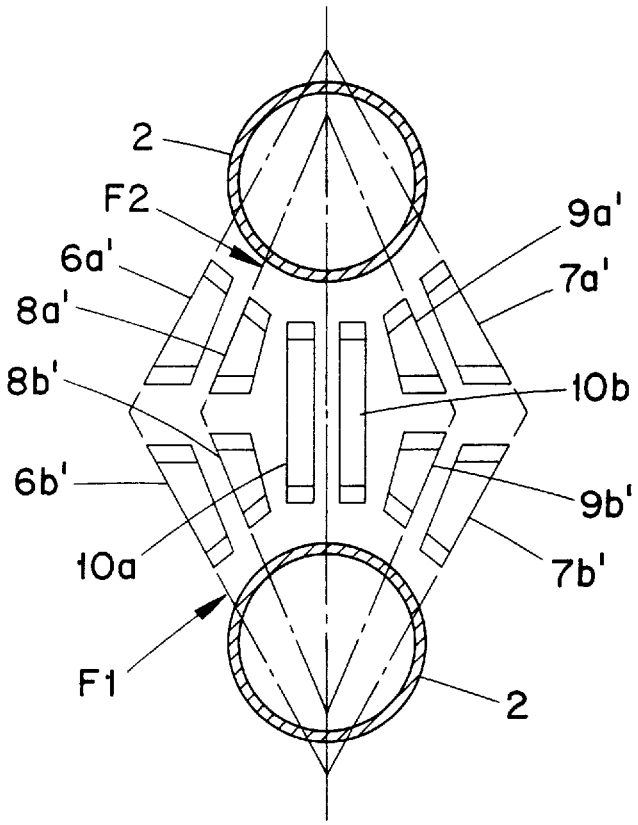
FIG. 9 is an enlarged view of one group of slits depicted in FIG. 6.

With respect to FIGS. 6 and 9, the slits 6*a* and 6*b* constitute upstream slits (since the air flow is from left to right in FIGS. 6 and 9) having upstream edges 6*a*' and 6*b*', respectively. The slits 7*a* and 7*b* constitute downstream slits having downstream edges 7*a*' and 7*b*', respectively. The edges 6*a*', 6*b*', 7*a*' and 7*b*' form, when extended, a first diamond-shaped figure F1 shown in broken lines in FIG. 9. The slits 8*a* and 8*b* constitute a first pair of additional slits disposed between the central slits 10*a*, 10*b* on the one hand, and the upstream slits 6*a*, 6*b* on the other hand. The slits 8*a*, 8*b* include upstream edges 8*a*', 8*b*'. The slits 9*a*, 9*b* constitute a second pair of additional slits disposed between the central slits 10*a*, 10*b* on the one hand, and the downstream slits 7*a*, 7*b* on the other hand. The slits 9*a*, 9*b* include downstream edges 9*a*', 9*b*'. The edges 8*a*', 8*b*', 9*a*', 9*b*' form, when extended, a second diamond shape figure F2 situated inside of the first diamond-shaped figure F1. An imaginary line L extending midway between and parallel to the central slits 10*a*, 10*b* intersects two of the pipes 2 and bisects each of the diamond-shaped figures F1, F2.

Shown in FIG. 6 is a second imaginary line L' which extends perpendicular to the first imaginary line L in bisecting relationship to the cental slits 10*a*, 10*b* of a first group G of slits, the line L' also intersecting a center axis of a pipe section 2*a* located downstream of the a first group G. Second and third groups of slits G1, G2 are disposed on opposite sides of the pipe section 2*a* and on opposite sides of the line L'. One of the downstream slits 7*a* of the first group G is disposed parallel to, and faces, a closest one 6*b* of the upstream slits of the second group G2 to form a continuous air flow path therewith. Also, the other of the downstream slits 7*b* of the first group G is disposed parallel to, and faces, a closest one 6*a* of the upstream slits of the third group G3 to form a continuous air flow path therewith.

As is apparent from the foregoing, the heat exchanger for air conditioners according to the present invention is provided with a plurality of slit type grilles each arranged around a heat transfer pipe in an X-shaped arrangement, and at the same time, is arranged with a plurality of slit type grilles vertically formed at the surface of and opposite sides of the flat pin in order to let the slit width WD becomes narrower as the slit approaches a pipe, so that air current flowing by the grilles are mixed with turbulent flows to thereby increase the heat transfer efficiency and reduce the cavitation zone formed in the back of each heat transfer pipe. In addition, the heat exchanger for the air conditioner according to the present invention can prevent a flow of the heat from the heat transfer pipes from being interrupted to thereby expedite heat transfer and at the same time, to increase heat transfer among the plurality of heat exchange pipes.

Although the a preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat exchanger comprising a plurality of parallel fins defining air flow spaces between one another, a plurality of refrigerant-conducting pipe sections extending perpendicularly through the fins in a zig-zag pattern, each fin including groups of slits projecting into a respective one of the spaces to render turbulent an air flow passing therethrough, each group of slits situated between two pipe sections and consisting of ten slits defined by a pair of upstream slits, a pair of downstream slits, a pair of central slits disposed between the upstream and downstream slits, a first pair of additional slits disposed between the central and upstream slits, and a second pair of additional slits disposed between the central and downstream slits, the upstream slits disposed adjacent an upstream side of a respective pipe section with reference to a direction of air flow, and the downstream slits disposed adjacent a downstream side of the respective pipe section, each of the upstream and downstream slits extending generally radially with respect to the respective pipe section and having a cross section which increases in a direction away from the respective pipe section, each of the upstream and downstream slits and the additional slits forming an acute angle with respect to the central slits, each of the upstream slits including an upstream edge, each of the downstream slits including a downstream edge, the upstream and downstream edges forming, when extended, a first diamond-shaped figure, each of the first pair of additional slits including an upstream edge, each of the second pair of additional slits including a downstream edge, the upstream and downstream edges of the additional slits forming, when extended, a second diamond-shaped figure lying inside of the first diamond-shaped figure, a first imaginary line extending midway between and parallel to the central slits of a first of the groups intersecting first and second ones of the pipe sections, a second imaginary line extending perpendicular to the first imaginary line while bisecting both of the pair of central slits and intersecting a center axis of a third pipe section disposed downstream of the first group, there being second and third groups on opposite sides of the third pipe section and on opposite sides of the second imaginary line, one of the downstream slits of the first group being disposed parallel to, and facing, a closest one of the upstream slits of the second group to form a continuous air flow path therewith, and the other of the downstream slits of the first group being disposed parallel to, and facing, a closest one of the upstream slits of the third group, to form a continuous air flow path therewith.

2. The heat exchanger according to claim 1, wherein the first pair of additional slits are disposed closer together than are the two upstream slits.

3. The heat exchanger according to claim 2, wherein the second pair of additional slits are disposed closer together than are the two downstream slits.

4. The heat exchanger according to claim 3, wherein the central slits are longer than any of the upstream slits, downstream slits, and additional slits.

* * * * *